United States Patent [19]

Sato

[11] 3,999,597

[45] Dec. 28, 1976

[54] SEAL DEVICE FOR USE IN A ROTARY TYPE REGENERATIVE HEAT EXCHANGER

[75] Inventor: Akira Sato, Susono, Japan

[73] Assignee: Toyota Jidosha Kogyo Kabushiki Kaisha, Toyoda, Japan

[22] Filed: Apr. 14, 1975

[21] Appl. No.: 567,877

[30] Foreign Application Priority Data

Sept. 30, 1974 Japan ..... 49-113188

[52] U.S. Cl. ..... 165/9; 60/39.51 H

[51] Int. Cl.[2] ..... F28D 19/00

[58] Field of Search ..... 165/9, 7; 60/39.51 H

[56] References Cited

UNITED STATES PATENTS

| | | | |
|---|---|---|---|
| 2,705,615 | 4/1955 | Rigby | 165/9 X |
| 3,232,335 | 2/1966 | Kalbfleisch | 165/9 |
| 3,669,183 | 6/1972 | Mock | 165/9 |
| 3,880,225 | 4/1975 | Penny | 165/9 |

*Primary Examiner*—Albert W. Davis, Jr.
*Attorney, Agent, or Firm*—Stevens, Davis, Miller & Mosher

[57] ABSTRACT

A seal device for use in a rotary type regenerative heat exchanger which is used for a gas turbine. This device consists of a seal-member urging mechanism adapted to urge the seal member against the flat surface portion of a heat-exchanger core, and a control mechanism which maintains a drive torque of a heat-exchanger core at an optimum value by operating the seal-member urging mechanism by comparison of a preset reference signal value with a signal of a value proportional to a drive torque required for driving the heat-exchanger core. The control mechanism further consists of a fluid pressure generating device such as for air or oil pressure and a mechanism for controlling the pressure within the fluid-pressure generating device.

8 Claims, 3 Drawing Figures

SEAL DEVICE FOR USE IN A ROTARY TYPE REGENERATIVE HEAT EXCHANGER

BACKGROUND OF THE INVENTION

This invention relates to a seal device for use in a rotary type regenerative heat exchanger which is used for a gas turbine.

Hitherto, it has been a common practice to urge seal members against the core surface of a heat exchanger by means of resilient members, which are supported by casing of a gas turbine engine, for the purpose of sealing the flat surface portion of the core against exhaust gases and air, the core having therein a plurality of independent, elongated holes having a small diameter. However, the aforesaid seal device poses difficulties in the assembly accuracy of resilient members as well as in controlling the accuracy in setting urging pressure for the resilient members. In addition, it is even more difficult to maintain a desired consistent seal-tightness, because of the variation in the pressure of the seal member being urged, which variation is responsible for the difference in the pressures of fluids prevailing inside and outside a seal member. For instance, if there occurs a reduction in the pressure of the seal members being urged against the flat surface portions of the heat-exchanger core, then the sealing function of the seal members will be impaired on the surface of the core, with the result that, in most cases, air at a high pressure leaks therefrom, thus reducing the amount of air being fed to a combustor of a gas turbine engine. This in turn lowers the output of an engine, with the accompanying reduction in fuel consumption rate. On the other hand, if there is created an excessively high pressure by the seal member being urged against the flat surface portions of the heat-exchanger core, then there results an extremely high frictional force acting on both members, thus leading to not only wear in the flat surface portions of the heat-exchanger core but also an increase in power for driving the heat-exchanger core. This then results in a lowering of the output of an engine, because the heat-exchanger core is driven by means of a turbine.

SUMMARY OF THE INVENTION

It is accordingly a principal object of the present invention to provide a seal device for use in a rotary type regenerative heat exchanger which is used for a gas turbine, which device maintains the pressure of a seal member being urged against the heat-exchanger core at an optimum level.

It is another object of the present invention to provide a seal device for use in a rotary type regenerative heat exchanger which is used for a gas turbine, which device maintains at an optimum level the power loss incurred in driving the heat-exchanger core.

It is a further object of the present invention to provide a seal device for use in a rotary type regenerative heat exchanger, which device insures the improvements in durability and reliability of a drive system of the heat-exchanger.

It is a still further object of the present invention to provide a seal device for use in a rotary type regenerative heat exchanger which is used for a gas turbine, which device presents minimized wear in the sliding surfaces of the core and sliding members, and hence improved durability, together with reliability from a functional viewpoint.

According to the present invention, there is provided for achieving the aforesaid objects a seal device for use in a rotary type regenerative heat exchanger which is used for a gas turbine, which device comprises a seal-member urging mechanism adapted to urge the seal members against the flat surface portions of a heat-exchanger core, and a control mechanism which maintains a drive torque required for the heat-exchanger core at an optimum level, by operating the seal-member urging mechanism, while comparing a preset reference signal value with a signal of a value proportional to the drive torque for the heat-exchanger core.

These and other objects and features of the present invention will be clear from a reading of the following part of the specification which indicate the embodiments of the invention.

DESCRIPTION OF THE PREFERRED EMBODIMENTS

Figure 1:
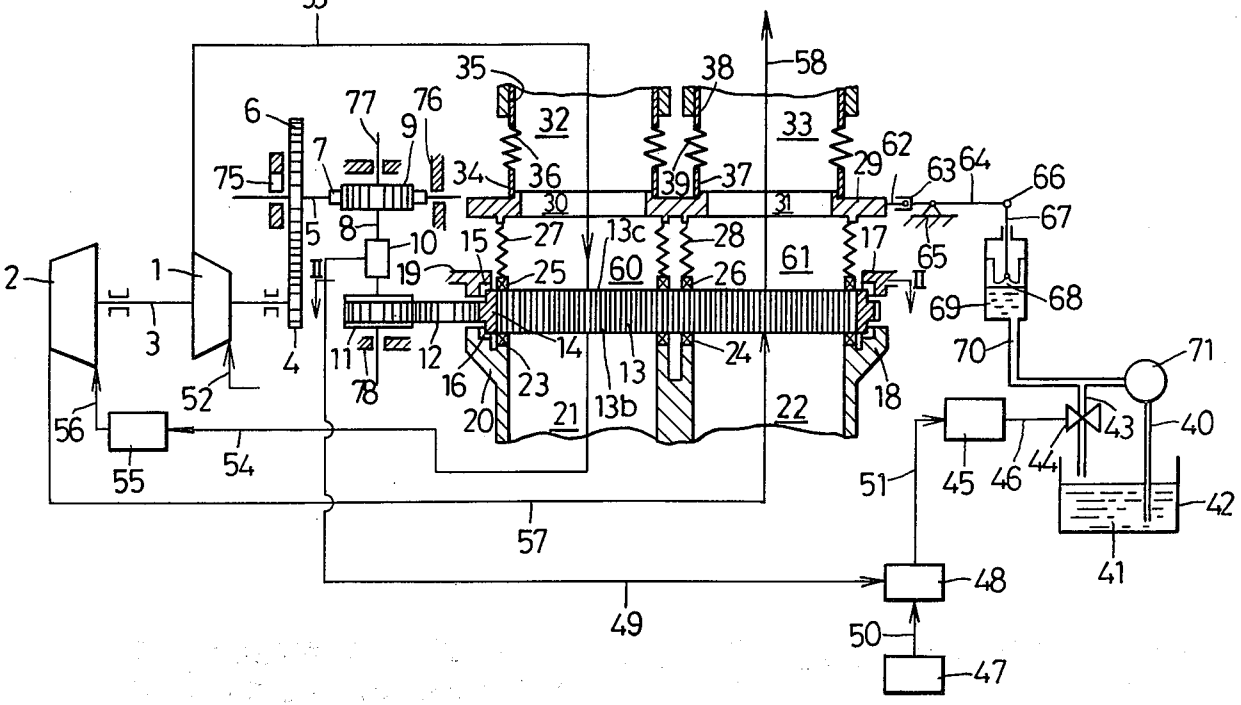
FIG. 1 is an explanatory view showing the essential part of the first embodiment of the invention.
Figure 2:
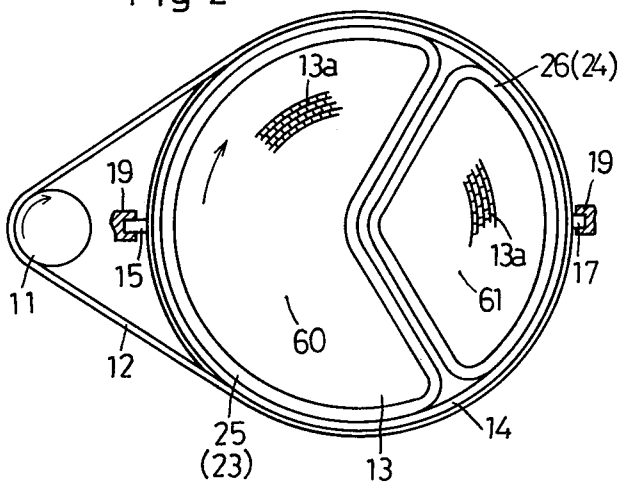
FIG. 2 is a cross-sectional view taken along the line II—II of FIG. 1.

Referring now to FIGS. 1 and 2 which show the first embodiment of the invention, a compressor 1 of a gas turbine engine is connected by a main shaft 3 to a turbine 2. Secured to the front end of the main shaft 3 is a small size gear 4, which meshes with a large size gear 6 secured to a reduction gear shaft 5. The reduction gear shaft 5 is journaled in bearings 75, 76 mounted in part of an engine casing. Secured to the reduction gear shaft 5 is a worm 7, with which meshes a worm wheel 9 secured to a drive shaft 8. The drive shaft 8 is rotatably supported at its opposite ends by means of bearings 77, 78 mounted in part of the engine casing, while a torque meter 10 and a pulley 11 are rigidly mounted on the drive shaft 8 between the above bearings 77, 78.

A rotary type heat exchanger includes a core 13 having a circular cross section and a plurality of elongated, small diameter holes 13a which extend vertically, and a gear wheel 14 fitted on the outer circumference of the core 13. The gear wheel 14 is connected through the medium of a timing belt 12 to the pulley 11. The heat-exchanger core 13 is rotatably supported by engine casings 19, 20 by means of bearings 15, 16, 17, 18 which are spaced a suitable distance from each other along the outer circumference of the gear wheel 14. The bearings 15, 16, 17, 18 have clearances adjusted relative to the gear wheel 14, such that the gear wheel 14 may slide relative to the bearings 15, 16, 17, 18 and hence is rotatable about the axis, along with the heat-exchanger core. Defined in the engine casing 20 are a part-cylindrical independent air passage 21 and an exhaust gas passage 22. Fitted over the entire peripheries of the passages 21, 22 which are close to the heat-exchanger core are seal members 23, 24 which abut a flat surface portion **13*b* of the heat-exchanger core 13 for maintaining gas tightness therefor. Abutting the other flat surface portion 13*c* of the heat-exchanger core 13 are seal members 25, 26 which are identical in shape to those of the seal members 23, 24. FIG. 2 shows a plan views of the seal members 23, 24, 25, 26**, in which an air passage is independent from an exhaust gas passage. The seal members 25, 26 are connected at one end thereof to flexible pipes 27, 28, respectively, over the entire peripheries of the members 25, 26 in gas-tight relation. Accordingly, the flexible pipes 27, 28 define a mutually-independent air passage 60 and exhaust gas passage 61. The other ends of the flexible pipes 27, 28 are connected to the passages 30, 31 in gas-tight relation over the entire peripheries of the pipes 27, 28, the passages 30, 31 being defined in a pressure plate 29 independently of each other. Connected to the pressure plate 29 are cylindrical air passage 32 and exhaust gas passage 33, which communicated with the passages 30, 31 in gas-tight relation on the side opposite the flexible pipes 27, 28. Walls 34, 35 and 37, 38 of air passage 32 and exhaust gas passage 33 are connected to the flexible pipes 36, 39 having moderate resiliency in their longitudinal direction, in gas-tight relation over the entire peripheries of the aforesaid walls. The walls 35, 38 are secured to an engine casing. The pressure plate 29 is formed on its circumference, with one or more arms 62 which are slidable within a fork 63 secured to one end of a lever 64. The lever 64 is connected at the other end thereof to a piston rod 67 connected to an oil pressure piston 68 through the medium of a joint 66. In addition, the lever 64 is rotatably supported at a fulcrum 65 which is fixedly placed on an engine casing but in a suitable position between the fork 68 and the joint 66. An oil pressure pipe 70 is connected at its one end to an oil pressure cylinder 69, in which is slidingly fitted the oil pressure piston 68, and the pipe 70 is connected at the other end thereof to an oil pressure pump 71. Connected to the oil pressure pump 71 is an oil suction pipe 40 which is open in oil 41 contained in an oil reservoir 42. Connected to the oil pressure pipe 70 between the oil pressure cylinder 69 and the oil pressure pump 71 is a bypass pipe 43 which is open to the oil reservoir 42, with a valve 44 being provided in the pipe 43. The valve 44 is connected to an output shaft 46 of a servo-motor 45 and driven thereby. The servo-motor 45 is connected by an electric wire 51 to a controller 48 which in turn is connected by an electric wire 49 to the torque meter 10 and by an electric wire 50 to a reference signal generating means 47 generates a signal in association with starting and stopping of an engine.

With the gas turbine engine, the compressor 1 is driven by the medium of the main shaft 3 by means of the turbine 2 so as to introduce air from atmosphere. The air, as shown by an arrow 52, is introduced under suction into the compressor 1, and, after being compressed, flows in a direction shown by arrow 53 via air passage 32, passage 30 in the pressure plate 29, air passage 60, heat-exchanger core 13 and air passage 21, in a direction shown by arrow 54, and eventually into the combustor 55. The air is then mixed, within the combustor 55, with fuel fed from a fuel supply means (not shown), and the mixture thus prepared is ignited by means of an ignition means (not shown), after which the mixture is burnt continuously. The high temperature gas produced due to the combustion then flows into the gas turbine as shown by an arrow 56, thereby driving the turbine 2. The combustion gases or exhaust gases from the turbine 2 flow as shown by an arrow 57 via passages in an engine, exhaust gas passage 22, heat-exchanger 13, exhaust gas passage 61, passage 31 in the pressure plate 29 and then exhaust gas passage 33, in a direction shown by arrow 58, and then into the atmosphere. Accordingly, the exhaust gases heat the heat exchanger core 13, while the heat-exchanger core is rotated by means of the engine-driven pulley 11 through the medium of the gear wheel 14 and timing belt 12, so that there takes place heat-exchange in the heat-exchanger core between the exhaust gases at a high temperature and low pressure, which have been discharged from the turbine 2, and the air at a low temperature and high pressure, which has been discharged from the compressor 1.

With The gas turbine having the aforesaid air and exhaust gas passages, the rotation of the turbine 2 causes the rotation of the drive shaft 8 by means of the main shaft 3, small size gear 4, large size gear 6, reduction gear shaft 5, worm 7 and worm wheel 9, so that the torque meter 10 and pulley 11 secured to the drive shaft 8 are rotated. The rotation of the pulley 11 causes the rotation of the heat-exchanger core 13 by way of timing belt 12 and gear wheel 14. At this time, the torque meter 10 detects a torque value required for driving the pulley 11 by means of the worm wheel 9 and then generates a signal of a value commensurate with the torque value thus detected, thereby feeding the aforesaid signal to the controller 48 by way of electric wire 49. On the other hand, the flat surface portion 13b of the heat-exchanger core 13 abuts the seal members 23, 24 secured to the engine casing 20, while the other flat surface portion 13c abuts the seal members 25, 26. When the piston rod 67 is lifted up by means of the oil pressure pistion 68, then the lever 64 rotates about the fulcrum 65, so that the fork 63 secured to the tip of the lever 65 lowers the pressure plate 29 through the medium of the tip portion of the arm 62 secured to the outer periphery of the pressure plate 29, whereby the seal members 25, 26 are urged against the flat surface portion 13c of the heat-exchanger core 13. In this respect, walls 34, 37 defining part of the air passage 32 and exhaust gas passage 33 move together with the pressure plate 29. However, the walls 35, 38 are secured to the engine casing, so they remain stationary. As shown, the flexible pipes 36 and 39 having desired resiliency and interposed between the walls 34, 35 and walls 37, 38, respectively, allow the smooth movement of the pressure plate 29. As a result, the forces or pressures of the seal members 25, 26 or 23, 24, which are exerted on the flat surface portions 13b or 13c are governed by the oil pressure within the oil pressure cylinder 69, which acts on the bottom surface of the oil pressure piston 68. The aforesaid oil pressure is created by means of the oil pressure pump 71 and causes the suction of the oil 41 from the oil reservoir to thereby introduce the same through the oil pressure pipe 70 to the oil pressure cylinder. The adjustment of the oil pressure is attended upon by an opening of the valve 44 in the bypass pipe 43 connected to the oil pressure pipe 70. In other words, the oil pressure pump 71 creates a given oil pressure all the time, but the desired level of the oil pressure acting on the oil pressure piston 68 is regulated by means of the valve 44. When the engine starts, then the oil pressure pump 71 starts to produce an oil pressure at a given level, whereupon the reference signal issued from the reference signal generator 47 is fed to the controller 48 by way of electric wire 50. On the other hand, with the engine running, the torque meter 10 feeds a signal to the controller 48, by way of the electric wire 49, which is in proportion to the torque value required for driving the pulley 11, i.e., the torque value required for the pulley 11 to rotate the heat-exchanger core 13. The controller 48 compares the value of a signal fed from the torque meter 10 with the reference signal value from the reference signal generator 47, thereby driving the servo-motor 45 to the effect that the value of a signal from the torque meter 10 will be equal to the reference signal value, while the controller 48 controls the opening of the valve 44 to regulate the oil pressure acting on the piston 68, with the result that the pressure of the seal members 23, 24 or 25, 26, being urged against the flat surface portions 13b or 13c of the heat-exchanger core 13, will be brought into proportion to the reference signal value.

The above embodiment shows that the pressures of the seal members which act on the flat surface portions of the heat-exchanger core are controlled by resorting to the oil pressure. However, electro-magnetic force, air pressure and the like may alternatively be used in place of oil pressure.

With the aforesaid embodiment, the flat surface portions of the heat-exchanger core are subjected to wear to some extent, so that the distance between the seal members and the flat surface portion of the heat-exchanger core is increased with the result of reduced pressures of the seal members. However, the servo-motor 45 is so controlled as to increase the pressures of the seal members being urged against the heat-exchanger core, so the drive torque for the heat-exchanger core may be maintained constant. In other words, the pressures of the seal members being urged against the heat-exchanger core may be maintained at a given level, while the gas tightness is also maintained between the seal members and the flat surface portion of the heat-exchanger core.

Figure 3:
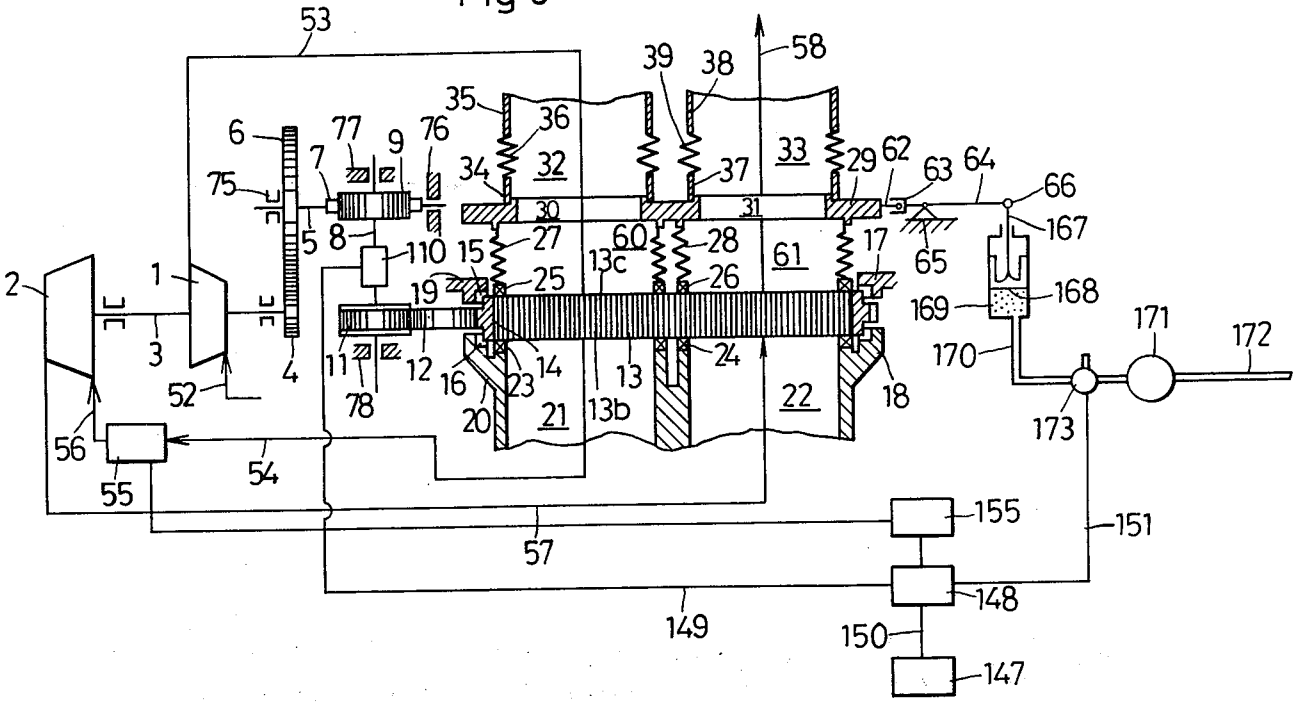
FIG. 3 is an explanatory view showing the essential part of the second embodiment of the invention.

FIG. 3 illustrates the second embodiment of the invention. With this embodiment, a piston rod 167 connected to a joint 66 of a lever 64 is connected to a piston 168 of an air cylinder 169. The air cylinder 169 is connected to a constant pressure valve 171 by way of an air pipe 170, the aforesaid constant pressure valve 171 in turn being connected to an air pressure source (not shown) such as a gas turbine engine compressor by way of an air pipe 172. The constant pressure valve 171 reduces the pressure from the air pressure source to a given level, thereby feeding the pressure thus reduced to the air cylinder 169. Provided in an air pipe 170 between the air cyliner 169 and the constant pressure valve 171 is an electromagnetic relief valve 173. A torque meter 110 generates a signal of a value which is proportional to the drive torque required for heat-exchanger core 13, as in the case of the first embodiment of the invention, and then the torque meter 110 feeds the signal to a comparator 148 by way of an electric wire 149. The comparator 148 is connected by an electric wire 150 to a reference signal generator 147 and to an electromagnetic relief valve 173 by an electric wire 151.

In the operation of the second embodiment, the air pressure in the air pipe 172 is increased due to the running of an engine, while the constant pressure valve 171 reduces the air pressure to a given level, thereby feeding the same to the air cyliner 169. Accordingly, the pressure to be transmitted to the pressure plate 29 by way of a piston 168 may be maintained constant, while the pressures of the seal members 23, 24, 25, 26 being urged against the flat surface portions **13*b*, 13*c*, of the heat-exchanger core 13 may be maintained to an optimum level with the assurance of desired consistent gas-tightness. On the other hand, the torque meter 110 generates a signal proportional to the drive torque required for driving the heat-exchanger core 13 and then feeds the signal to the comparator 148 by way of the electric wire 149. The comparator 148 compares the reference signal from the reference signal generator 147 with the signal from the torque meter 110, thereby issuing a command signal, when the valve of a signal from the torque meter 110 is greater than the value of the reference signal (specified value), so the relief valve 173 is opened by means of a signal fed by way of the electric wire 151. During the normal running of the heat-exchanger, i.e., as long as the drive torque for the heat exchanger is maintained at an optimum value, there remains least difference between the value of a signal from the torque meter 110 and that of the reference signal, so that the comparator 148 remains in an insensible range, and hence the electromagnetic relief valve 173 will not be opened. As a result, a constant air pressure is fed to the air cylinder 169 by means of the constant pressure valve 171. However, when there takes place wear in the seal members 23, 24, 25, 26 or in the flat surface portions 13*b*, 13*c* of the heat-exchanger core 13 with the resulting peeling of coating layers thereon, then the frictional force prevailing between both members will be extremely increased (The pressure acting between both members is maintained constant, but the coefficient of friction will be increased.) Then, the value of a signal issued from the torque meter 110 becomes greater as compared with that of the reference signal, so that the comparator 148 issues a command signal so as to open the electromagnetic relief valve 173. This in turn reduces the pressure in the air cylinder 169, with the resulting reduction in the pressures of the seal members 23, 24, 25, 26 being urged against the flat surface portions 13*b*, 13*c* of the heat-exchanger core 13. As a result, the progress of wear or damage on the flat surface portions 13*b*, 13*c* of the heat-exchanger core 13 may be retarded or prevented. On the other hand, when a command signal representing an abnormal value is fed from the comparator 148 to a fuel supply means 155, the operation of the fuel supply means 155** may be interrupted, preventing the failure of an engine.

With the second embodiment, the seal members are urged against the flat surface portions of the heat-exchanger core at a given pressure, so that the drive torque required for driving the heat-exchanger core may be maintained to an optimum level, as long as the frictional force is not increased due to the wear in the coatings applied to the flat surface portions of the heat-exchanger core, while the gas-tightness may be maintained for the seal members. In addition, in case the frictional force is increased due to the wear in the aforesaid coatings the pressures of the seal members may be rapidly reduced, and the engine may be stopped, thereby preventing damage to the heat-exchanger.

While the present invention has been described herein with reference to certain exemplary embodiments thereof, it should be understood that various changes, modifications and alterations may be effected without departing from the spirit and the scope of the present invention, as defined in the appended claims.

What is claimed is:

1. A seal device for use in a rotary type regenerative heat exchanger for an engine, in which seal members, provided at the end portions of fluid passages, are urged against the flat surface portions of a heat-exchanger core which is in rotation, for the purpose of sealing fluids to be heat-exchanged by said core, said seal members being immovably fixed to an engine casing, wherein said device comprises: a seal-member urging means for urging said seal members against the flat surface portions of said heat-exchanger core; means for directly detecting the drive torque of said heat-exchanger core and generating a first signal having a value proportional to the drive torque required for driving said core; and a control means comparing said first signal with a preset second reference signal to control said seal-member urging means to maintain the drive torque for said heat-exchanger core at an optimum value.

2. A seal device for use in a rotary type regenerative heat exchanger, as set forth in claim 1, wherein said seal-member urging means includes: at least one lever which is pivotally supported by said engine casing and has a fork portion at its one end; and a seal-member attaching means connected to said fork portion of said lever.

3. A seal device for use in a rotary type regenerative heat exchanger, as set forth in claim 2, wherein said seal-member attaching means includes: two independent flexible pipes to which are attached the seal members, for sealing exhaust gases and air, at one end of said pipes in gas-tight releation; a pressure plate provided with passages for exhaust gases and air and having said two flexible pipes attached thereto at the other ends of said pipes in gas-tight releation; and an arm portion attached to the outer periphery of said pressure plate and slidably coupled in said fork portion of said lever.

4. A seal device for use in a rotary type regenerative heat exchanger, as set forth in claim 3, wherein said pressure plate is resiliently supported by said engine casing through the medium of two additional flexible pipes which communicate said exhaust gas passage and air passage in said pressure plate, on the side of said pressure plate opposite said two independent flexible pipes.

5. A seal device for use in a rotary type regenerative heat exchanger, as set forth in claim 2, wherein said control means includes: an oil-pressure generating means including an oil cylinder having a piston rod connected to the other end of said lever of said seal-member urging means; a single valve for regulating the pressure in said oil-pressure generating means; a servo-motor adjusting the opening of said valve; a reference signal generator for generating said second reference signal; and a comparator for comparing said first and second signals; and wherein said means for directly detecting includes a torque meter to generate said first signal, said servo-motor being controlled by said comparator to equalize said first and second signals.

6. A seal device for use in a rotary type regenerative heat exchanger, as set forth in claim 5, wherein said torque meter is attached to a shaft of a pulley which drives said heat-exchanger core by means of a timing belt.

7. A seal device for use in a rotary type regenerative heat exchanger, as set forth in claim 2, wherein said control means includes: an air pressure generating means including an air cylinder having a piston rod connected to the other end of said lever of said seal-member urging means; a constant pressure valve for maintaining the air pressure in said air-pressure generating means constant; a relief valve for bleeding pressure from said air-pressure generating means to atmosphere; a reference signal generator for generating said second reference signal; and a comparator for comparing said first and second signals; and wherein said means for directly detecting includes a torque meter to generate said first signal, wherein when said first signal exceeds said second signal, said comparator causes said relief valve to open to reduce the air pressure in said air pressure generating means and to stop the operaton of a fuel supply means for the engine.

8. A seal device for use in a rotary type regenerative heat exchanger, as set forth in claim 7, wherein said torque meter is attached to a shaft of a pulley which drives said heat-exchanger core by means of a timing belt.

* * * * *